US005210465A

United States Patent [19]

Squibb

[11] Patent Number: 5,210,465

[45] Date of Patent: May 11, 1993

[54] MAGNETRON HAVING AN $TM_{01}$ OUTPUT COUPLING PROBE PASSING THROUGH A COUPLING IRIS

[75] Inventor: Keith Squibb, Chelmsford, United Kingdom

[73] Assignee: EEV Limited, Chelmsford, United Kingdom

[21] Appl. No.: 604,482

[22] Filed: Oct. 26, 1990

[30] Foreign Application Priority Data

Nov. 6, 1989 [GB] United Kingdom ..... 8925000

[51] Int. Cl.[5] ..... H01J 23/44; H01J 25/50

[52] U.S. Cl. ..... 315/39.53; 333/230

[58] Field of Search ..... 315/39.53, 39.51; 333/230

[56] References Cited

U.S. PATENT DOCUMENTS

| | | | |
|---|---|---|---|
| 2,884,563 | 4/1959 | Crook et al. | 315/39.75 |
| 2,967,973 | 1/1961 | Vaccaro | 315/39.53 |
| 2,972,084 | 2/1961 | Esterson et al. | 315/39.53 |
| 3,173,054 | 3/1965 | Baker | 315/39.53 |
| 3,265,850 | 8/1966 | Crapuchettes | 315/39.53 X |
| 3,543,082 | 11/1970 | Boehm | 315/39.53 X |
| 3,588,588 | 6/1971 | Numata | 315/39.53 |
| 3,885,221 | 5/1975 | Lewis | 315/39.53 X |
| 4,331,935 | 5/1982 | Thornber | 331/90 |

FOREIGN PATENT DOCUMENTS

| | | |
|---|---|---|
| 2467479 | 4/1981 | France . |
| 63-231840 | 9/1988 | Japan . |
| 612513 | 11/1948 | United Kingdom . |
| 745729 | 2/1956 | United Kingdom . |
| 834628 | 5/1960 | United Kingdom . |
| 998815 | 7/1965 | United Kingdom . |
| 1194020 | 6/1970 | United Kingdom . |
| 1365644 | 9/1974 | United Kingdom . |
| 2067350 | 7/1981 | United Kingdom . |

*Primary Examiner*—Paul M. Dzierzynski
*Assistant Examiner*—Benny T. Lee
*Attorney, Agent, or Firm*—Spencer, Frank & Schneider

[57] ABSTRACT

An output of a magnetron operating in the $TM_{01}$ mode has a ceramic output window which is planar. As ceramic material may have a higher dielectric constant than glass a longer output probe can be used which, combined with the fact that the window is planar, gives good mode purity thus reducing heating and arcing in the window. Ceramic also has a higher melting point than glass which means that cooling of the window is less critical.

8 Claims, 2 Drawing Sheets

MAGNETRON HAVING AN $TM_{01}$ OUTPUT COUPLING PROBE PASSING THROUGH A COUPLING IRIS

BACKGROUND OF THE INVENTION

This invention relates to magnetrons.

Typically a magnetron consists of a central cathode surrounded by an anode which defines a number of resonant cavities, the volume between the anode and the cathode being evacuated. A magnet surrounds the anode to produce a steady state magnetic field between the anode and cathode and an electric field is applied across them. Electrons emitted from the cathode interact with the fields within the cavities, prodcing r.f. oscillations. The generated radiation is coupled out of the magnetron via an output.

At the output of one particular type of magnetron, the radiation is coupled out of the cavities to an output waveguide via a probe which is connected to the anode by conductive straps. The probe transmits the radiation through a glass window, which forms part of the magnetron vacuum envelope, and into an output waveguide. The glass window is domed in order to withstand the pressure difference between the vacuum inside the magnetron and the ambient pressure.

BRIEF SUMMARY OF THE INVENTION

According to the invention there is provided a magnetron comprising: a vacuum envelope, part of which is formed by a planar ceramic window; an output probe within the vacuum envelope; and an iris defining an aperture into which at least part of the probe projects, such that, in use, radiation generated by the magnetron is coupled by the probe through the window and into an output waveguide.

Since ceramic materials may be chosen for the window that have a higher melting point than glass, cooling does not become necessary unless the magnetron is operated at very high power levels, unlike conventional magnetron arrangements. Also, ceramic materials are available that have higher dielectric constants than glass. A longer length of probe may be used than would be possible if a conventional glass window were to be used. This enables the mode purity of the device to be improved. The planar configuration of the window is possible because there are ceramics available which are physically stronger than glass and therefore do not need to be domed to resist the pressure differential between the magnetron interior and exterior. The planar window has been found to increase the mode purity of the magnetron over that obtainable by using a conventional domed window. The inventor believes that this is due to the electric field lines of the generated radiation in the magnetron being approximately tangential to the window surface which cannot be the case when the window is domed. The use of an iris has also been found to increase the mode purity.

Preferably, the radiation progates through the window in the $TM_{01}$ mode.

One particularly advantageous ceramic for use in a magnetron in accordance with the invention is alumina because of its high dielectric constant, strength and ease of manufacture. However, other ceramics may also be suitable.

Preferably, the output window has a thickness of substantially 0.02 of the wavelength of radiation which is generated by the magnetron. This relationship has been found to provide a window which is matched to avoid performance reducing resonances which would cause destructive heating of the window.

Preferably, the probe has a length of, substantially 0.26 of the wavelength of the radiation which, in use, is generated by the magnetron. This is preferable because it provides better mode purity. Generally it has been found that the further the probe projects into and through the iris the less contamination from other modes is present in the output radiation.

In one particular embodiment of the invention a magnetron is operated at a frequency of 2.85 GHz and has a window with a thickness in the range 1 to 3mm.

The invention has been found to be particularly useful for magnetrons operated at a frequency in the range 2 to 6 GHz and for power levels in the range of 4 to 6 kW.

BRIEF DESCRIPTION OF THE DRAWINGS

A specific embodiment of the invention is now described, by way of example only, with reference to the accompanying drawings, in which.

DESCRIPTION OF THE EMBODIMENT

Figure 1:
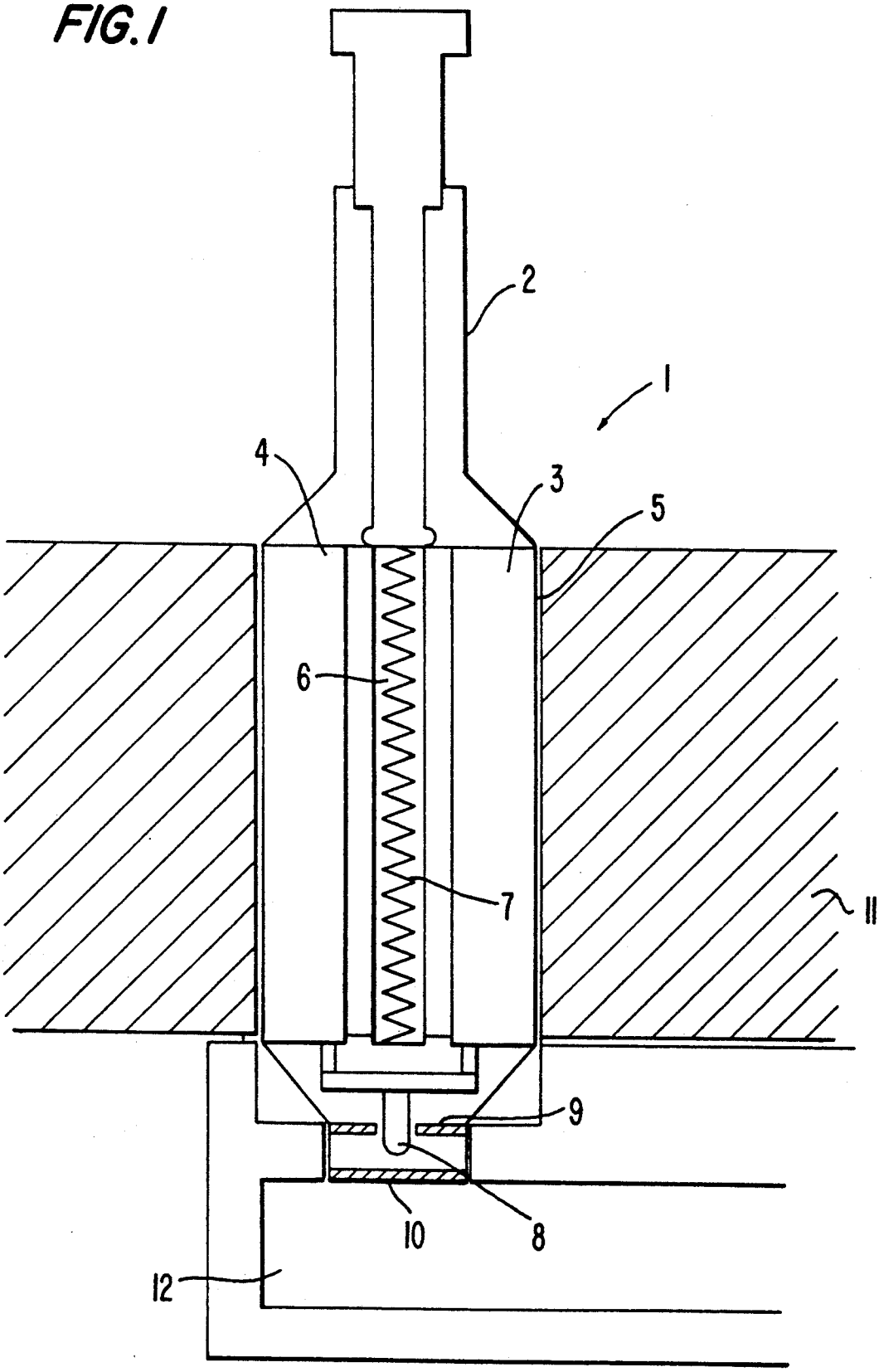
FIG. 1 is a schematic partial longitudinal section of a magnetron in accordance with the invention.

With reference to FIG. 1, a magnetron 1 comprises an outer body 2 within which is housed an anode structure comprising a plurality of anode vanes, two of which 3, 4 are shown, and a cylinder 5. The anode vanes are brazed into grooves in the cylinder 5 to define resonant cavities around a central cathode 6 which is heated by a filament 7. The volume between the cathode 6 and the anode vanes is the interaction space of the magnetron 1.

Alternate vanes are connected to a probe 8 which has a length of about 30 mm, or about 0.26 of the wavelength of the radiation generated by the magnetron, and projects through an aperture formed by a copper iris 9. A planar, alumina, window 10 with a thickness of about 3 mm, or about 0.02 of the wavelength of the radiation generated by the magnetron, forms part of the vacuum envelope of the magnetron 1. This thickness is suitable for a magnetron to be operated at a frequency of about 2.85 GHz. A solenoid 11 surrounds the anode structure to provide a magnetic field of about 1600 Gauss in the interaction space. The end of the magnetron 1 having the window 10 is adjacent to an output waveguide 12.

In use, the heater 7 brings the material of the cathode 6 to an operating temperature at which electrons are emitted. A voltage of about 55 kV is applied across, the anode structure, which includes anode vanes 3 and 4, and cathode 6 via electrical connections, which are not shown for reasons of clarity. The electrons move under the influence of both the electric and magnetic fields. Resonance occurs in the cavities and r.f. energy is generated. The r.f. energy is coupled to the probe 8 and iris 9 through the planar, alumina window 10 into the output waveguide 12 along which it is propagated.

Figure 2:
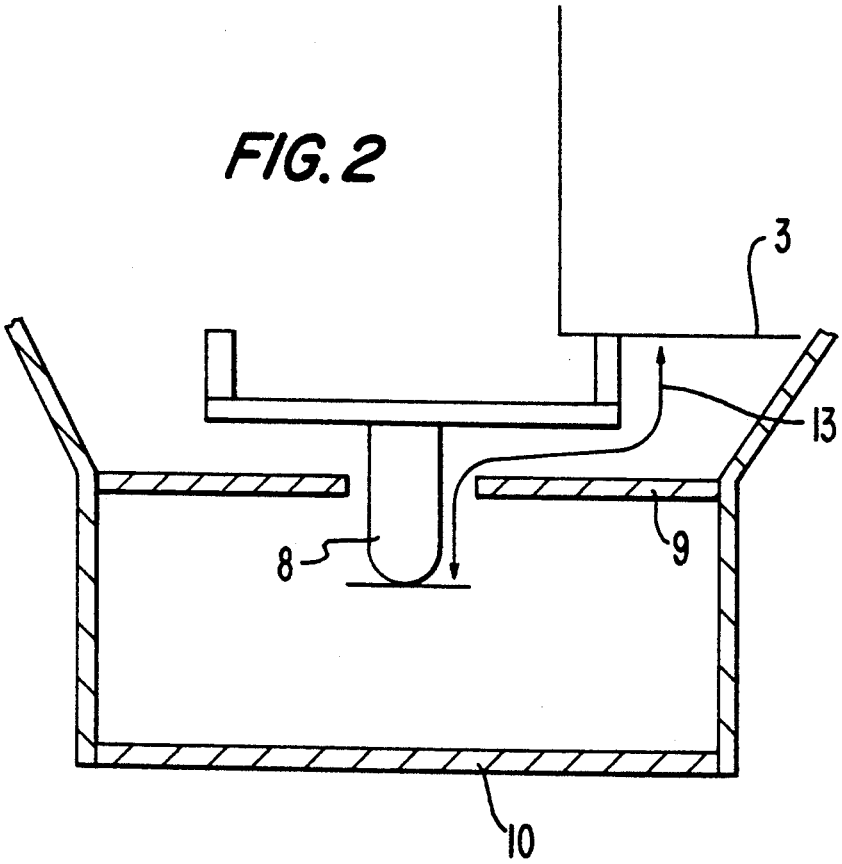
FIG. 2 is an enlargement of part of FIG. 1.

The purpose of, and the factors governing the design of the iris 9 will now be described with reference to FIG. 2. It has been found that if a path length 13 between the tip of the probe 8 and anode vanes 3 is constricted by the iris 9 to about three quarters of the wavelength of the radiation to be generated by the magnetron 1 the mode purity is increased.

Care must be exercised in dimensioning the iris 13 because if the aperture is made too small, i.e. the probe-iris separation is small, discharge will occur causing damage to the probe 8.

Since the window 10 is made of alumina the magnetron may be opeaated at a power level of 5 kW mean and 5 MW peak without damage and without the necessity for cooling.

I claim:

1. An output coupling structure for a magnetron, said magnetron including a cathode and an anode structure having a plurality of cavities arranged to generate microwave radiation in the $TM_{01}$mode, an output waveguide having an opening in a wall thereof, said output structure being coupled between said cavities and said output waveguide, and comprising:

an elongate output probe connected to said anode structure;

a planar iris disposed substantially perpendicular to said probe, said output probe having a free end projecting through an aperture in said planar iris in non-contacting relationship therewith; and a planar ceramic window positioned substantially in parallel with said iris across the opening in the wall of the output waveguide, the free end of said probe being mounted relative to the output waveguide so that the window does not substantially project into the waveguide through the opening in the wall thereof, whereby radiation generated by the magnetron in the $TM_{01}$mode is coupled by the probe through the window and into the output waveguide.

2. An output coupling structure as claimed in claim 1 in which the radiation generated by said magnetron has a mean power level in the range 5 to 6 kW.

3. An output coupling structure as claimed in claim 1 wherein said window is made from alumina.

4. An output coupling structure as claimed in claim 1 wherein said planar ceramic window has a thickness of substantially 0.02 of the wavelength of the microwave radiation generated by said magnetron.

5. An output coupling structure as claimed in claim 1 wherein said window has a thickness in the range 1 to 3 mm.

6. An output coupling structure as claimed in claim 1 wherein said probe has a length of substantially 0.26 of the wavelength of the microwave radiation generated by said magnetron.

7. An output coupling structure as claimed in claim 1 wherein said output probe has a length in the range 20 to 40 mm.

8. An output coupling structure as claimed in claim 1 in which the radiation generated by said magnetron has a frequency in the range 2 to 4 GHz.

* * * * *